US007344051B2

(12) United States Patent
Flamingo et al.

(10) Patent No.: US 7,344,051 B2
(45) Date of Patent: Mar. 18, 2008

(54) MARKER HOLDER AND DISPENSING DEVICE

(76) Inventors: Angelo Lamar Flamingo, 1089 W. Port Dr. #151, Port Washington, WI (US) 53074; James Gregory Whitfield, II, 3200 Todds Rd #1417, Lexington, KY (US) 40509; Todd Alan Thiel, 7775 Cincinnati Rd., Waupaca, WI (US) 40370

( * ) Notice: Subject to any disclaimer, the term of this patent is extended or adjusted under 35 U.S.C. 154(b) by 278 days.

(21) Appl. No.: 11/155,237

(22) Filed: Jun. 17, 2005

(65) Prior Publication Data

US 2006/0027592 A1 Feb. 9, 2006

Related U.S. Application Data

(60) Provisional application No. 60/580,609, filed on Jun. 17, 2004.

(51) Int. Cl.
*G07F 13/10* (2006.01)

(52) U.S. Cl. ..... 221/312 A; 221/213; 221/29

(58) Field of Classification Search ..... 221/29, 221/213, 312 A

See application file for complete search history.

(56) References Cited

U.S. PATENT DOCUMENTS

| | | | | |
|---|---|---|---|---|
| 3,228,555 | A * | 1/1966 | Pinto | 221/312 A |
| 3,464,590 | A * | 9/1969 | Giannettino | 221/312 R |
| 4,600,118 | A * | 7/1986 | Martin | 221/312 A |
| 6,112,944 | A * | 9/2000 | Van Hoorn et al. | 221/312 A |

* cited by examiner

*Primary Examiner*—Gene O. Crawford
*Assistant Examiner*—Timothy Waggoner

(57) ABSTRACT

A flexible marker holding and dispensing device. An elongate shaft includes a proximal end and a distal end extending away from the proximal end. A handle is connected to the proximal end of the elongate shaft. A trigger component protrudes from the elongate shaft at the proximal end near the handle. A flexible marker engaging mechanism is housed within a portion of the elongate shaft and is in communication with the trigger component.

5 Claims, 9 Drawing Sheets

MARKER HOLDER AND DISPENSING DEVICE

RELATED APPLICATIONS

This application claims priority from U.S. Provisional Application No. 60/580,609, filed Jun. 17, 2004.

BACKGROUND

The present invention relates to marker devices with examples relating to hand-held portable and vehicle mounted devices used to store and dispense flexible markers. Marking devices, such as traffic cones, ornamental signs, and poles, have historically been employed to direct attention toward particular events, such as advertising campaigns by merchants, or alert motorist and pedestrians of possibly dangerous hazards and obstacles that may be encountered on the roadway or passageway. While a variety of such markers have been used to signal upcoming events or impediments, no one has previously made or used a marker holding and dispensing device in accordance with the present invention.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

FIG. 1(*b*) illustrates a perspective view of the flexible marker holding and dispensing device of FIG. 1(*a*) with the trigger component at an activated position;

FIG. 3(*b*) illustrates a cross-sectional view of the elongate shaft of the flexible marker holding and dispensing device of FIG. 3(*a*);

FIG. 5(*b*) illustrates a top view of a flexible marker platform;

FIG. 6(*b*) illustrates an example of the combination of a flexible marker platform and a flexible marker;

FIG. 7(*b*) illustrates a side view of a flexible marker holding and dispensing device housing a plurality of flexible marker platforms and flexible markers;

FIG. 8(*b*) illustrates an example of the operation of a flexible marker holding and dispensing device; and FIG. 8(*c*) illustrates an example of the operation of a flexible marker holding and dispensing device.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1A:
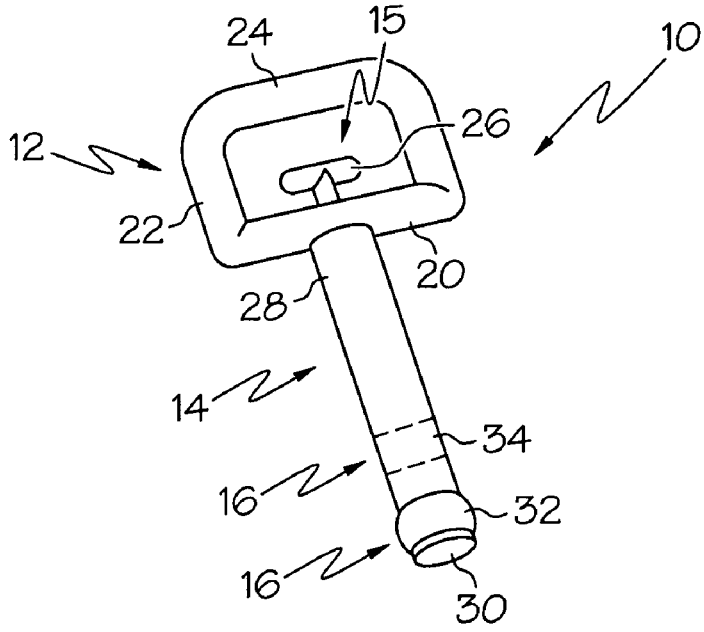
FIG. 1(*a*) illustrates a perspective view of an example of a flexible marker holding and dispensing device having a trigger component at a resting position.
Figure 1B:
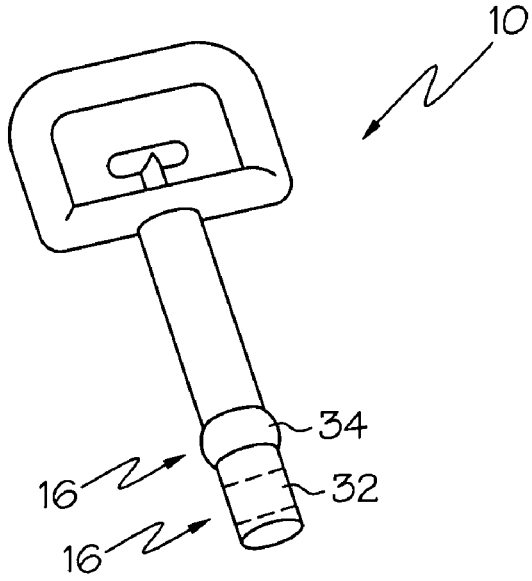
Figure 2:
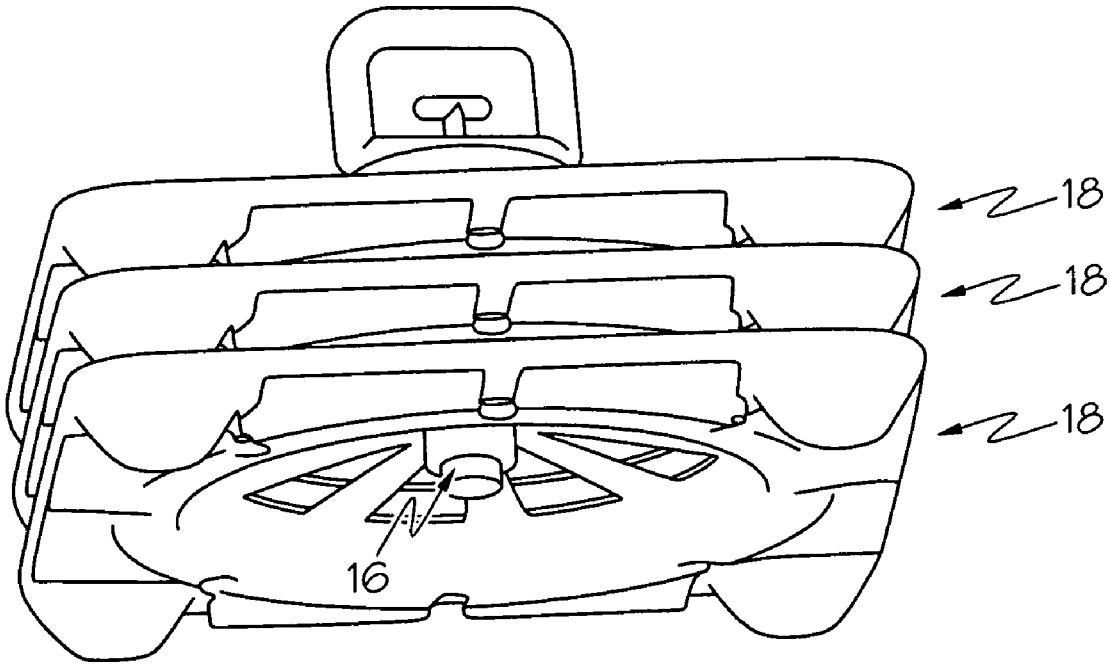
FIG. 2 illustrates a side view of a flexible marker holding and dispensing device housing a plurality of flexible marker platforms and flexible markers.

FIGS. 1(*a*), 1(*b*) and 2 illustrate an example of a marker holder and dispensing device (10). The marker holder and dispensing device is a hand-held portable tote device, but can also be fixed and mounted on a motorized vehicle, a wheeled cart, or a fixed platform if so desired. The marker holder and dispensing device includes a handle (12), an elongate shaft (14), a trigger component (15) protruding from a portion of the elongate shaft near the handle, and a marker engaging mechanism (16) housed within the elongate shaft and in communication with the trigger component. The markers, typically made from flexible materials but not specifically limited as such, are shown and discussed below, and are each releasably fastened to a marker platform (18)(shown more clearly in FIG. 2) and stored on the elongate shaft by inserting the shaft through central openings in each of the markers and marker platforms.

The elongate shaft includes a proximal end (28) and a distal end (30) extending linearly away from the proximal end. As shown here, the elongate shaft is substantially linear, however, non-linear shafts could also be used. As shown here, the proximal end of the elongate shaft is connected to the base of the handle and the distal end is a free end portion of the elongate shaft. As shown in the drawings, the shaft is straight and is substantially rigid. A symmetry of the body of the shaft is not particularly limited as long as it can be inserted through central openings in the flexible markers that are to be stored on the shaft. In the present example, the shaft has a circular cross-section.

While FIGS. 1(*a*) and 1(*b*) show the shaft having an outer circumferential surface, the shaft could take the form of non-circumferential structures having planar sides such as, for example, a rectangular member. In such a configuration, the width dimensions of the sides of the shaft would not be particularly limited so long as the shaft could fit through the central openings in the flexible markers. Furthermore, the shaft can be constructed to have any length so long as there is enough space between the ground and the dispensing end of the shaft to allow for discharge of the flexible markers from the shaft.

The handle (12) is connected to the proximal end (28) of the elongate shaft. The handle includes a base (20) attached at the proximal end and a gripping member (24) located above the base of the handle and extending along a plane that is substantially parallel to the base. While the physical dimensions of and materials forming the gripping member are not particularly limited, the gripping member needs to be at least grippable by a user's hand when the flexible marker holding and dispensing device is employed as a portable tote device.

The trigger component (15) protrudes from an opening (not shown) formed through the base of the handle such that it is surrounded by the base (20), gripping member (24) and side walls (22) of the handle. As seen here, the trigger component is a T-shaped member (26) that is movable in the Z-axis direction with respect to the elongate shaft. However, the movement of the trigger component can also be in other directions, such as along the X- and/or Y-directions, or rotatable around the Z-axis (i.e., a twisting movement).

The physical dimensions and materials used to make the trigger component are not particularly limited. The trigger component can take on any form so long as it is movable, either by a user's hand or by a component driven by some other mechanical or electro-mechanical means (not shown). For example, a ball- or square-shaped trigger component (not shown) can be substituted for the T-shaped trigger component (15).

The marker engaging mechanism (16) is formed on, within, or as a part of the elongate shaft. In a process that is explained below, the marker engaging mechanism moveably engages corresponding portions of the flexible markers to releasably secure the flexible markers on the elongate shaft. To this end, the marker engaging mechanism is in mechanical communication with the trigger component and traverses longitudinally through at least a portion of the elongate shaft from the proximal end toward the distal end. It is to be understood, however, that the marker engaging mechanism (16) could traverse coaxially through a hollow elongate shaft or through a conduit formed in a portion of an otherwise solid elongate shaft.

The marker engaging mechanism shown in FIGS. 1(*a*) and 1(*b*) comprises first marker stop (32) located near the distal end of the elongate shaft and a second marker stop (34) positioned between the first marker stop (32) and the proximal end (28) of the elongate shaft. As shown in the drawings, the first and second marker stops are spaced apart from one another. It is to be understood, however, that the marker engaging mechanism could also comprise a single unit having moveable parts that is located anywhere between the proximal and distal ends of the elongate shaft.

The movement of the first and second marker stops is controlled manually a user's hand or automatically through mechanical and/or computerized means (not shown). For example, a computerized control unit (not shown) can be configured, using known software and hardware systems, to communicate with and control the movement of the trigger component, the displacement of which correspondingly controls the movement of the first and second marker stops. The electronic communication between the computerized control unit and the marker engaging mechanism can be through a wireless communications system.

While not particularly limited as such, the first and second marker stops shown in FIGS. 1(*a*) and 1(*b*) are expandable segments (32,34) of the elongate shaft itself. Upon movement of the trigger component, these expandable segments increase in diameter as they expand laterally away from the outer surface of the elongate shaft. One way of accomplishing this would be to employ a ball and recess type mechanism. For example, while not shown in the drawings, a rod positioned within the elongate shaft would have notched or recessed portions housing balls therein. The expandable segments would be in a non-expanded state when the balls are positioned in the recesses of the rod. The expandable segments, however, would be in an expanded state when the balls are dislodged, through operation of the trigger component, from the recesses in the rod and become located between an outer surface of the rod and an inner wall of the expandable segments of the elongate shaft. Consequently, the pressure exerted on the inner wall of the expandable segments from the dislodged balls would cause the expandable segments to bulge outward with respect to the outer surface of the elongate shaft. Furthermore, the dislodged balls could be used as the expandable segments of the shaft, without an outer covering on the shaft, so long as the elongate shaft is designed in such a way as to retain the balls while they are in the dislodged state.

The expandable segments forming the first and second marker stops can be made from any expandable material having enough rigidity to support the flexible markers on the elongate shaft; however, a wear resistant elastomer with a low frictional surface would be ideal. It should be understood, however, that other non-expandable structures can be substituted for the first and second marker stops. For example, a screw thread (not shown) formed around the outer circumferential surface of the elongate shaft can be adapted to mate with corresponding screw threads on an inner circumferential surface in the central openings on the flexible markers. Accordingly, the threaded engagement between the mating screw threads on the elongate shaft and the central openings in the flexible markers would act as the marker engaging mechanism.

Furthermore, while FIGS. 1(*a*) and 1(*b*) provide examples of first and second marker stops that are formed as a part of the elongate shaft, the first and second marker stops could also be formed as components that are external from the elongate shaft. In this instance, the device attaching the flexible marker holder and dispenser to a portion of a vehicle or other fixed platform (not shown) can be adapted to include appendages, such as flat plates or the like, which engage portions on the flexible markers to hold and release the markers from the shaft upon operation by a controlling means that is also an external component apart from the elongate shaft. For example, a computerized control unit (not shown) can be configured, using known software and hardware systems, to electronically communicate with and control the movement of the first and second marker stops.

Figure 3A:
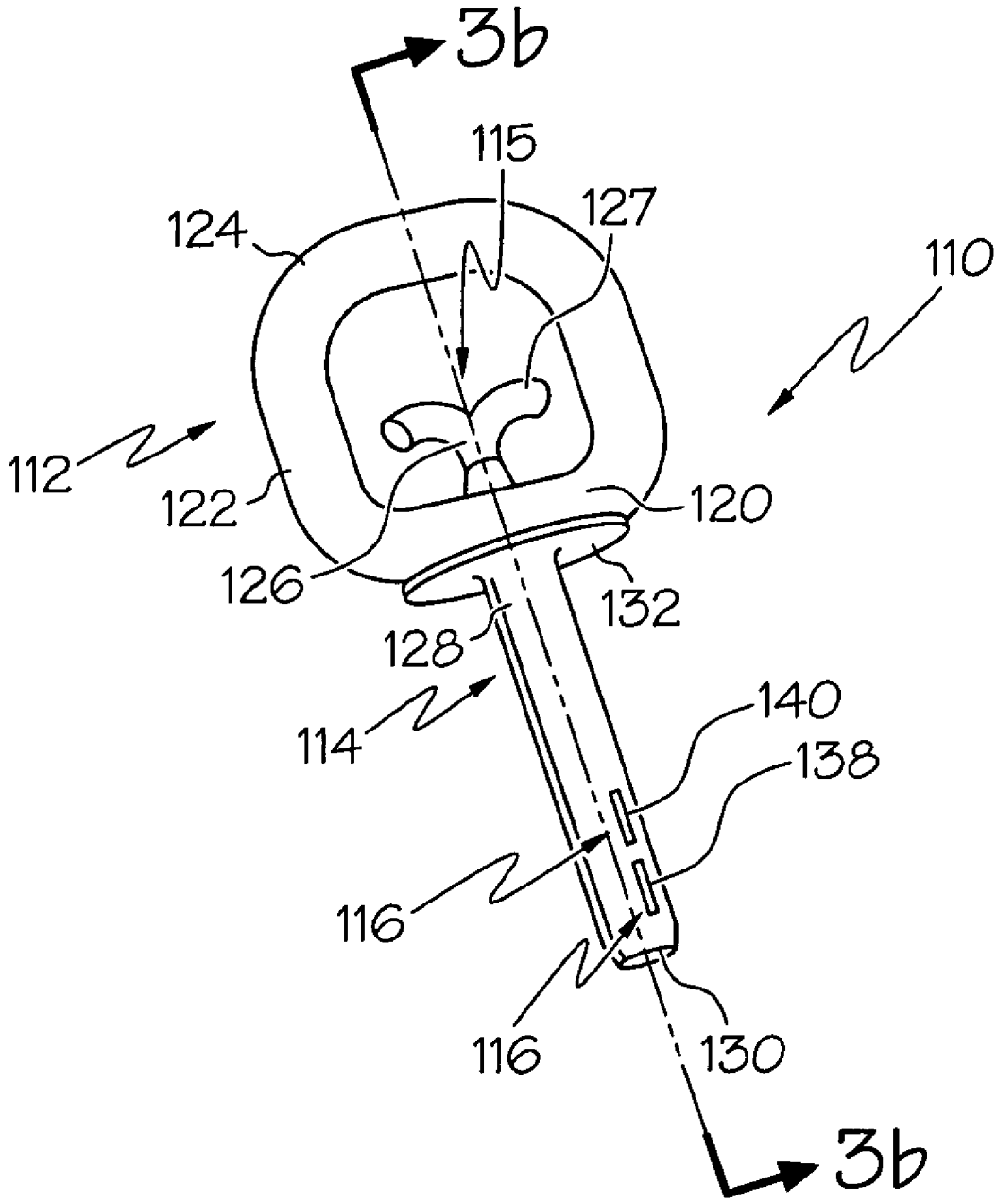
FIG. 3(*a*) illustrates a perspective view of an example of a flexible marker holding and dispensing device with an exploded view of a distal end portion thereof.
Figure 3B:
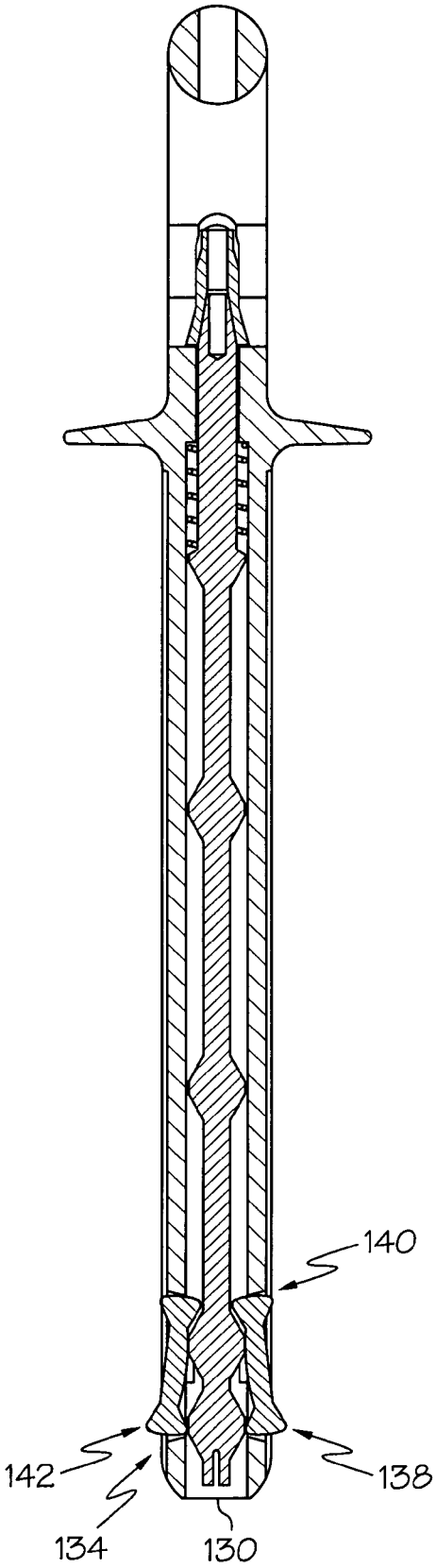

FIGS. 3(*a*), 3(*b*) and 4 illustrate another example of a marker holder and dispenser (110). The marker holder and dispenser is a hand-held portable tote device, but can also be fixed and mounted on a motorized vehicle, a wheeled cart, or a fixed platform if so desired. The marker holder and dispenser (110) includes a handle (112), an elongate shaft (114), a trigger component (115) protruding from a portion of the elongate shaft near the handle, and a marker engaging mechanism (116) housed within the elongate shaft and in communication with the trigger component. The markers, typically made from flexible materials but not limited as such, are shown and discussed below, and are each releasably fastened to a marker platform (118) (shown more clearly in FIG. 4) and stored on the elongate shaft by inserting the shaft through central openings in each of the flexible markers and marker platforms.

The elongate shaft includes a proximal end (128) and a distal end (130) extending away from the proximal end. While the proximal end of the elongate shaft is connected to the base of the handle, the distal end is a free end portion of the elongate shaft. As shown in the drawings, the shaft is straight and is substantially rigid, however, non-linear shafts could also be used. A diameter of the body of the shaft is not particularly limited as long as it can be inserted through central openings in the flexible markers that are to be stored on the shaft. By way of non-limiting example, the diameter of the body of the elongate shaft in this example ranges from 1.125" to 0.875".

A diameter of the shaft near the base of the handle is comparatively larger than a diameter of the rest of the body of the shaft such that a stand or pedestal (132) is formed under the base of the handle. The diameter of the stand or pedestal is not particularly limited, but in this example ranges from 2.75" to 3.25". As shown in FIGS. 3(*a*) and 3(*b*), the outer diameter of the shaft from just underneath the stand or pedestal (132) toward the free end (130) is substantially constant and gradually narrows at a tip end (134) of the elongate shaft. The diameter of the narrowed tip end of the elongate shaft is also not particularly limited, but in this example ranges from 0.75" to 0.625".

Figure 4:
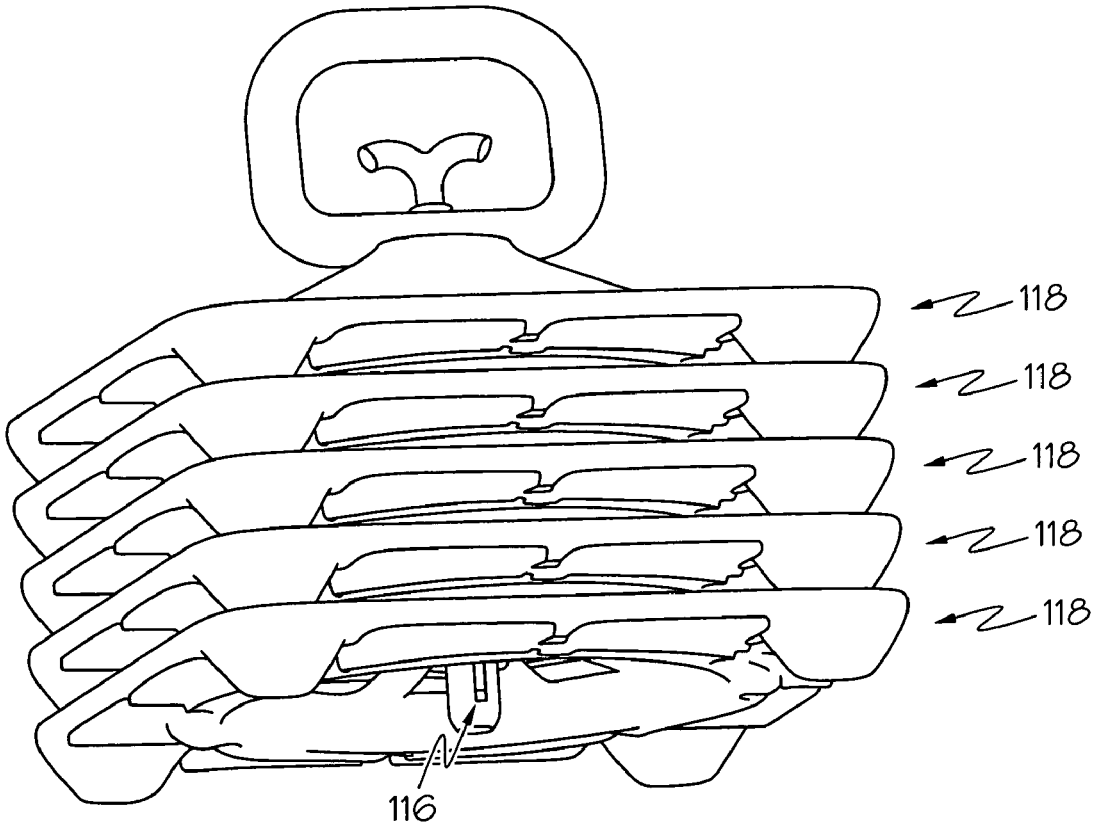
FIG. 4 illustrates a side view of a flexible marker holding and dispensing device housing a plurality of flexible marker platforms and flexible markers.

While FIGS. 3(*a*) and 3(*b*) show the shaft having an outer circumferential surface, the shaft could take the form of non-circumferential structures having planar sides such as, for example, a rectangular member. In such a configuration, the width dimensions of the sides of the shaft would not be particularly limited so long as the shaft could fit through the central openings in the flexible markers. By way of non-limiting example, the length of the elongate shaft between the proximal and distal ends is 10.875". However, the shaft can be formed to have any length so long as there is enough space between the ground and the dispensing end of the shaft to allow for discharge of the flexible markers from the shaft. For example, FIG. 4 shows that the length of the elongate shaft has been adjusted such that six flexible markers (118) are loaded on and are ready for dispensing from the marker holder and dispenser (110).

The handle (112) is connected to the proximal end (128) of the elongate shaft. The handle includes a base (120) attached at the proximal end and a gripping member (124) located above the base of the handle and extending along a plane that is substantially parallel to the base. While the physical dimensions of and materials forming the gripping member are not particularly limited, the gripping member needs to be at least grippable by a user's hand when the flexible marker holding and dispensing device is employed as a portable tote device.

The trigger component (115) protrudes from an opening (not shown) formed through the base of the handle such that it is surrounded by the base (120), gripping member (124) and side walls (122) of the handle. As seen here, the trigger component is a T-shaped member (126) having arcuate extensions (127) and is movable in the Z-axis direction with respect to the elongate shaft. However, the movement of the trigger component can also be in other directions, such as along the X- and/or Y-directions, or rotatable around the Z-axis (i.e., a twisting movement).

The physical dimensions and materials used to make the trigger component are not particularly limited. The trigger component can take on any form so long as it is movable, either by a user's hand or by a component driven by some other mechanical or electro-mechanical means (not shown). For example, a ball- or square-shaped trigger component (not shown) can be substituted for the T-shaped trigger component (115).

As shown in FIG. 3(*b*), the marker engaging mechanism (116), which comprises first and second marker stops (138) and (140), discussed below, is formed within the elongate shaft. In a process that is explained below, the marker engaging mechanism moveably engages corresponding portions of the flexible markers to releasably secure the flexible markers on the elongate shaft. To this end, the marker engaging mechanism is in mechanical communication with the trigger component (115) and traverses longitudinally through at least a portion of the elongate shaft from the proximal end toward the distal end. It is to be understood, however, that the marker engaging mechanism (116) can traverse coaxially through a hollow elongate shaft or through a conduit formed in a portion of an otherwise solid elongate shaft.

The marker engaging mechanism shown in FIG. 3(*a*) comprises a first marker stop (138) located near the distal end of the elongate shaft and a second marker stop (140) positioned between the first marker stop (138) and the proximal end (128) of the elongate shaft. As shown in the drawings, the first and second marker stops are spaced apart from one another. The movement of the first and second marker stops is controlled manually a user's hand or automatically through mechanical and/or computerized means (not shown). For example, a computerized control unit (not shown) can be configured, using known software and hardware systems, to communicate with and control the movement of the trigger component, the displacement of which correspondingly controls the movement of the first and second marker stops. The electronic communication between the computerized control unit and the marker engaging mechanism can be through a wireless communications system.

FIG. 3(*b*) shows that the first and second marker stops (138) and (140), respectively, are tabs positioned within and extending from slot (142) formed in the elongate shaft. These tabs can be formed from any material having the resiliency to catch and hold the flexible markers on the elongate shaft; however, the following materials are exemplary: high tensile strength plastic, machinable steel, and formable mid-range tensile strength metal. As shown in FIG. 3(*b*), tabs (138) and (140) comprise a single marker engaging mechanism which are rotatable around an axis that is perpendicular to the longitudinal axis of the elongate shaft. This allows each end of the marker engaging mechanism to separately extend from the slot within the elongate shaft and engage the flexible markers stored on the shaft.

It should also be apparent that other structures could be substituted for the first and second marker stops. For example, a screw thread (not shown) formed around the outer circumferential surface of the elongate shaft can be adapted to mate with corresponding screw threads on an inner circumferential surface in the central openings on the flexible markers. Accordingly, the threaded engagement between the mating screw threads on the elongate shaft and the central openings in the flexible markers would act as the marker engaging mechanism.

Furthermore, while FIGS. 3(*a*) and 3(*b*) provide an example of the first and second marker stops that are formed as tabs positioned within and extending from slot (142) formed in the elongate shaft, the first and second marker stops could also be formed as components that are external from the elongate shaft. In this instance, the device attaching the flexible marker holder and dispenser to a portion of a vehicle or other fixed platform (not shown) can be adapted to include appendages, such as flat plates or the like, which engage portions on the flexible markers to hold and release the markers from the shaft upon operation by a controlling means that is also an external component apart from the elongate shaft. For example, a computerized control unit (not shown) can be configured, using known software and hardware systems, to electronically communicate with and control the movement of the first and second marker stops.

Moreover, while FIG. 3(*b*) provides an example of first and second marker stops that are separate components apart from the trigger, the first and second marker stops could also be formed to be an intricate part of trigger if so desired.

Figure 5A:
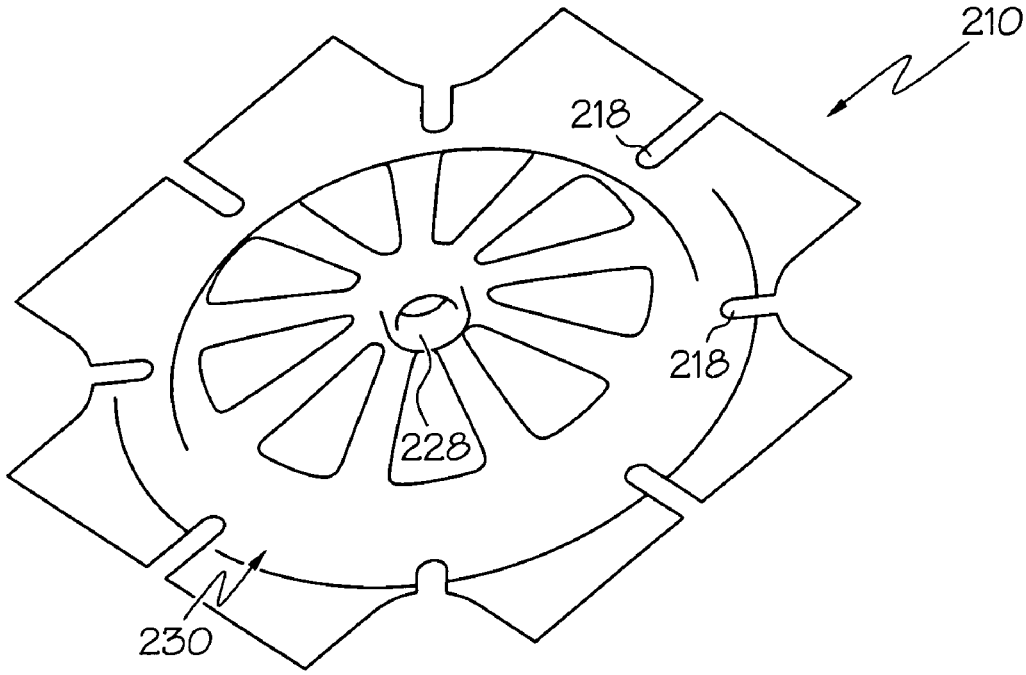
FIG. 5(*a*) illustrates a bottom view of a flexible marker platform.
Figure 5B:
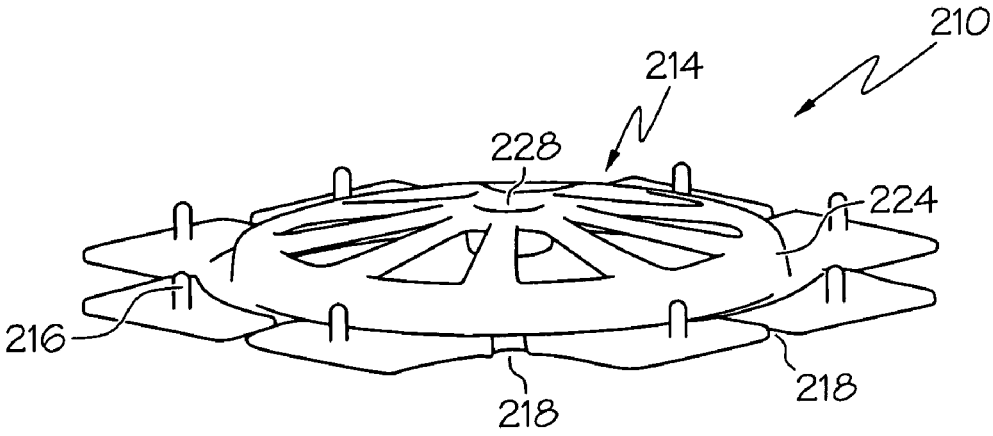
Figure 6A:
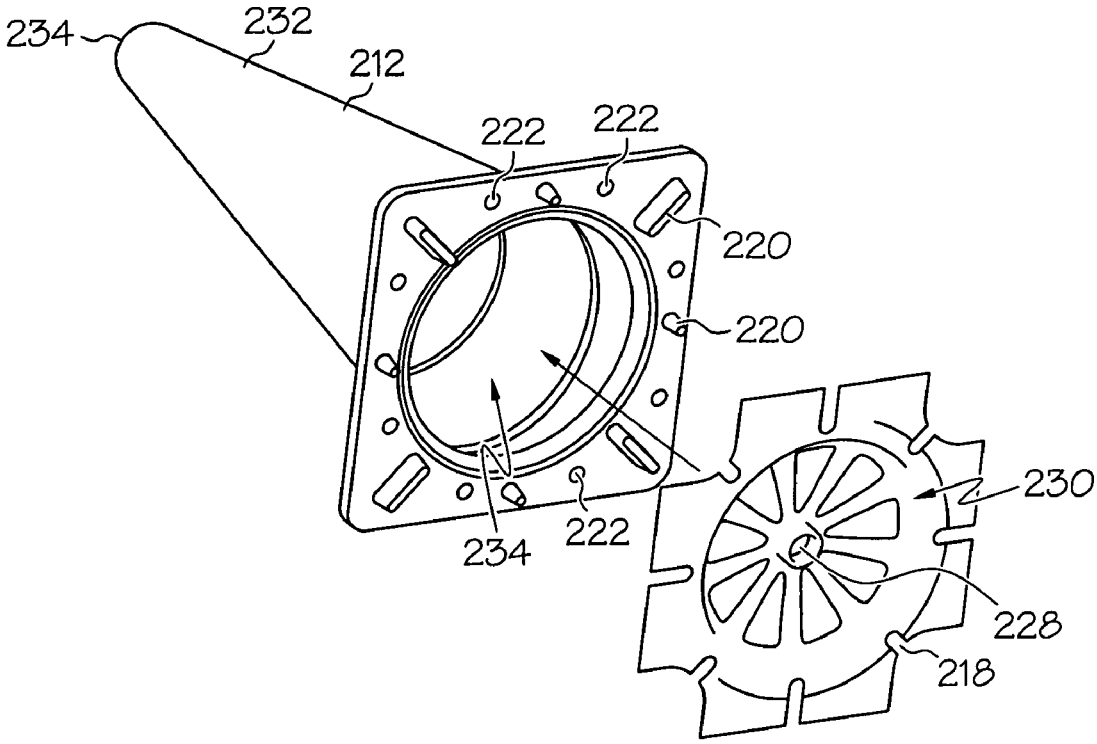
FIG. 6(*a*) illustrates an example of the combination of a flexible marker platform and a flexible marker.
Figure 6B:
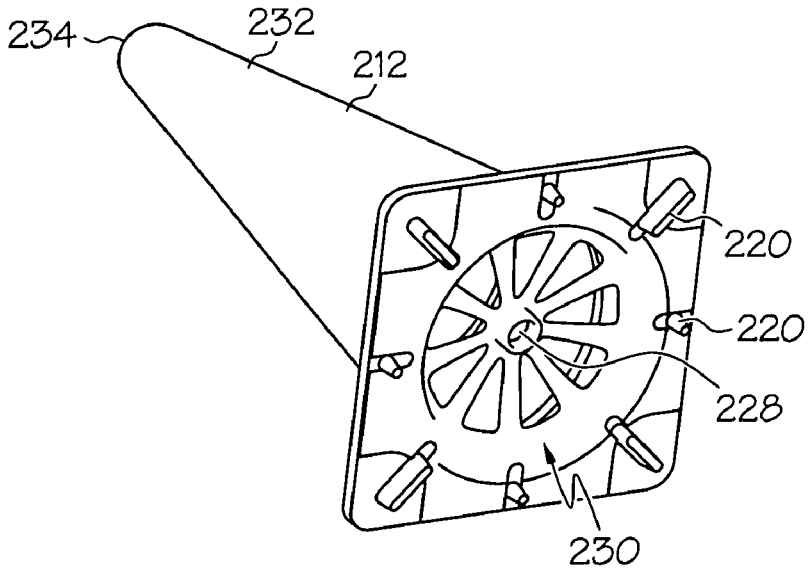

FIGS. 5(*a*), 5(*b*), 6(*a*) and 6(*b*) illustrate the detail of a marker platform (210) and how it is releasably fastened to the bottom portion of each flexible marker (212) (shown more clearly in FIGS. 6(*a*) and 6(*b*)). As shown in the drawings, the marker platform includes an upper surface (214) having locking towers (216) and slots (218) formed around an outer peripheral portion (i.e., a flange). As shown in FIGS. 6(*a*) and 6(*b*), the locking towers and slots mate with corresponding fastening structures on the outer periphery of the bottom of a wide variety of flexible markers. While the drawings show that the corresponding fastening structures on the base of the flexible markers (212) are projecting feet members (220) that mate with slots (218) on the marker platforms, such fastening structures can also include holes (222) formed in the flexible marker base which receive locking towers (216). It should also be understood that the corresponding fastening structures on the flexible markers can be pre-existing structures or can be structures that are formed around the time that the flexible markers are attached to the marker platforms.

The hub or center part of the upper surface of each marker platform has a convex portion (224) which, when fastened to a flexible marker, extends beyond a lower surface plane of the base of each flexible marker and into a cavity (234) (shown more clearly in FIGS. 6(*a*) and 6(*b*)) within the interior of the marker. The convex center part of the marker platforms also includes an opening (228) for receiving the elongate shaft for coupling the marker platform and elongate shaft to one another. As discussed above, depending on the type of marker stops used, the inner circumferential surface of opening (228) can include screw threads corresponding to threads on the outer circumferential surface of the elongate shaft.

Figure 7A:
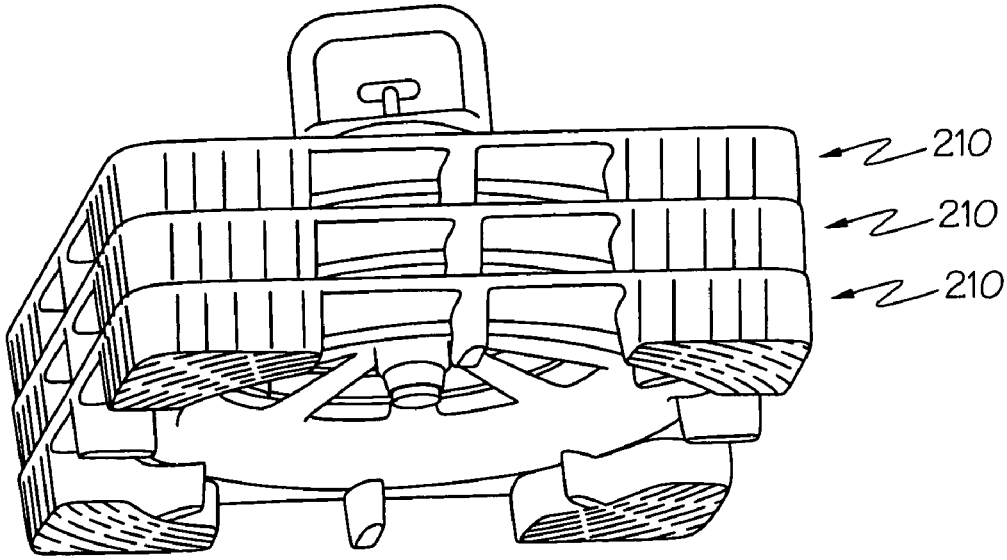
FIG. 7(*a*) illustrates a side view of a flexible marker holding and dispensing device housing a plurality of flexible marker platforms and flexible markers.
Figure 7B:
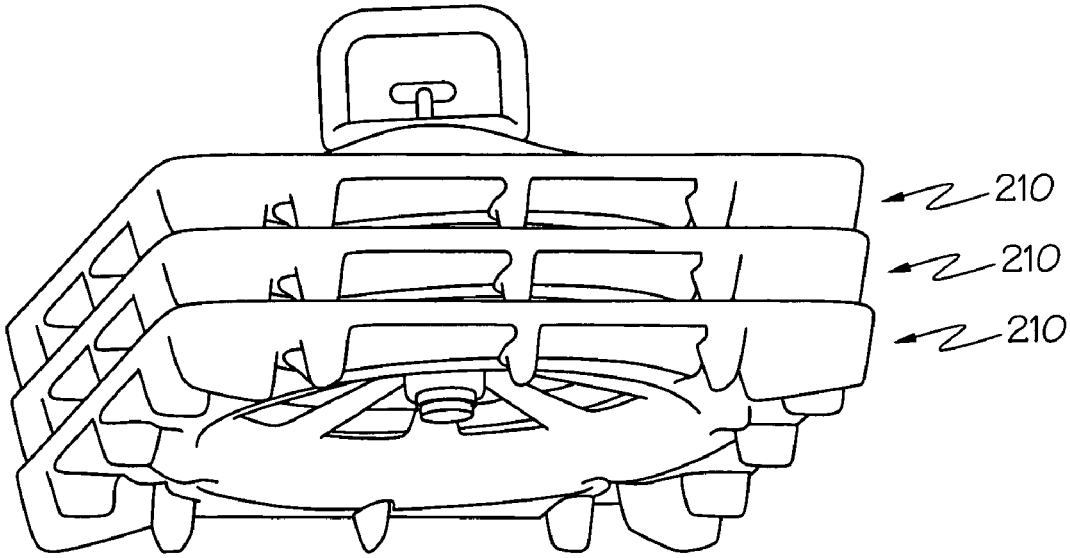

As can be taken from the above, and additionally illustrated in FIGS. 7(*a*) and 7(*b*), the marker platform (210) is not limited to any particular configuration, so long as it includes structures for mating with a base portion of the flexible markers and includes an opening for receiving the elongate shaft. While locking towers (216) and slots (218) provide the structures by which the marker platforms and flexible markers are mechanically coupled to one another, it is to be understood that other fastening structures are contemplated including, but not limited to, adhesives, heat sealing at an interfacial zone between the markers and marker platforms, staples, rivets or the like.

The marker platforms (210) generate stability for the comparatively softer bottom part of the flexible markers and maintain separation between the flexible markers when they are compressed against one another (i.e., the flexible markers do not bind to or become entangled with one another). To this end, the lower surface plane of the marker platforms has a concave shape (230) which receives an upper part (232) of the flexible marker positioned immediately below. This design facilitates compact storage of the collapsed flexible markers by providing an area into which the markers are positioned when compacted. In addition, the concave lower surface of the marker platform also provides a resistive wall against which the flexible markers push off to facilitate the uncoiling or unfolding of the flexible markers upon discharge.

Before discussing the manner in which the markers are stored on and released from the elongate shaft, the markers dispensed from the flexible marker holder and dispenser can be of any type or shape. The markers are preferably collapsible, for example, by means of a spring, coil or the material forming the markers themselves. The markers also preferably have an opening for receiving the elongate shaft. Typical examples of the markers include, but are in no way limited to, traffic cones, flag poles, sign poles, barrels, rods, or any other ornamental signage capable of being collapsed and receiving an elongated holding member through a central opening.

Figure 8B:
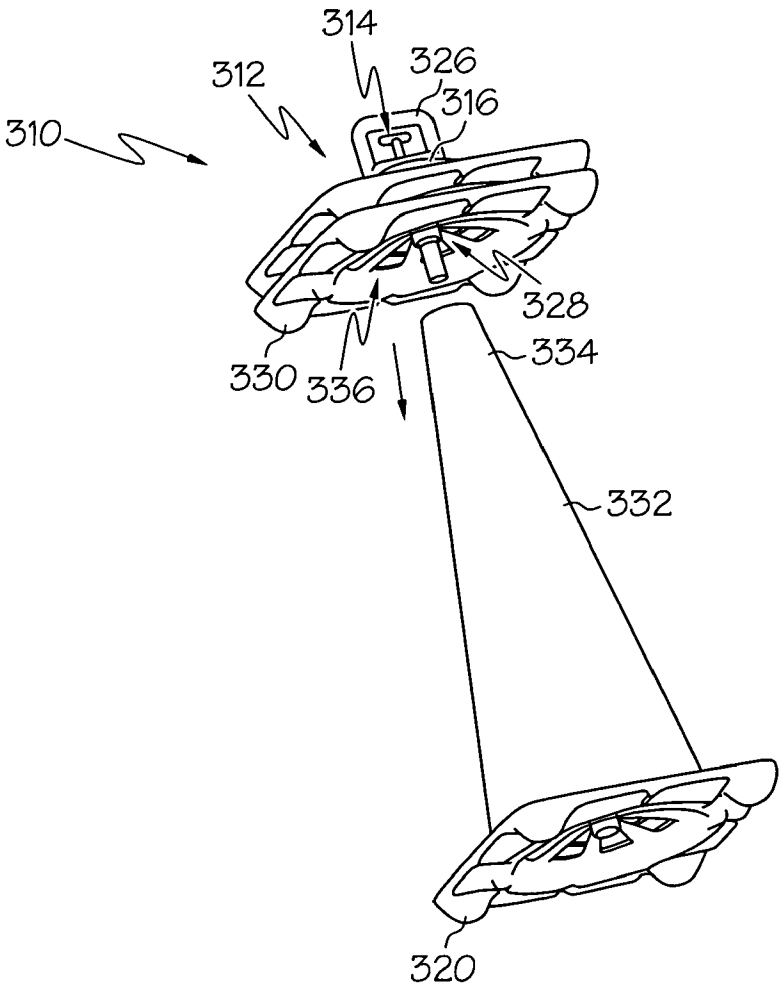
FIG. 8(*a*) illustrates an example of the operation of a flexible marker holding and dispensing device.
Figure 8A:
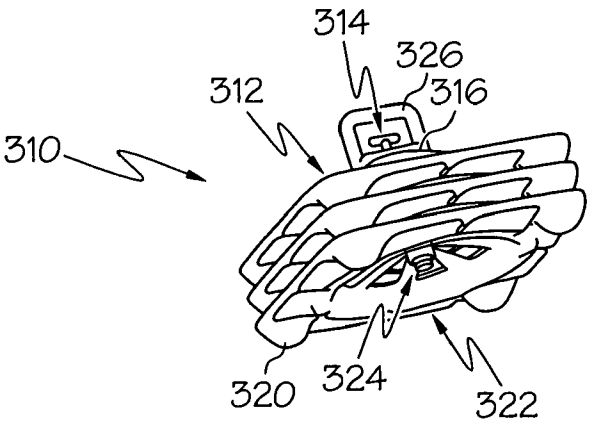
Figure 8C:
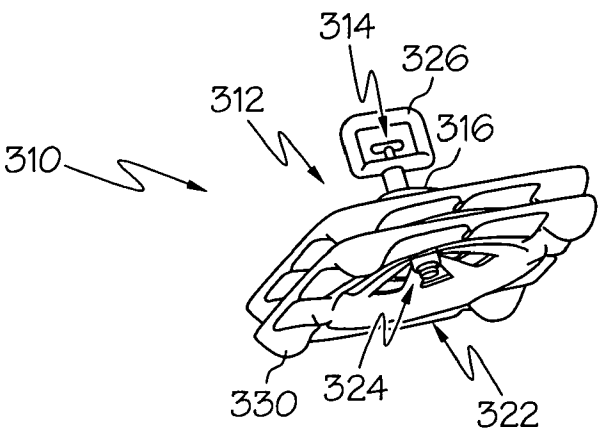

FIGS. 8(*a*), 8(*b*) and 8(*c*) illustrate the operation of a flexible marker holder and dispenser (310). FIG. 8(*a*) shows the flexible marker holder and dispenser loaded with three flexible markers (obscured from view), each attached to a marker platform (312) which are stacked and aligned with one another between the opposite ends of the elongate shaft. As shown here, T-shaped trigger part (314) is in a resting position next to base (316) of the handle and a lowermost marker platform (320) is in a dispensing position (322) at the free end of the elongate shaft. In this resting state, the first marker stop (324) is mechanically coupled or engaged with the lowermost marker platform (320) to thereby hold the lowermost marker platform, and all other marker platforms above it, on the elongate shaft. The second marker stop (obstructed from view in FIG. 8(*a*)) is in a non-expanded or non-extended position and is not in physical contact with any of the three marker platforms.

FIG. 8(*b*) illustrates the activation of the marker engaging mechanism, which in this example, comprises first marker stop (324) and second marker stop (328). As shown here, when T-shaped trigger part (314) is moved, either manually or automatically, away from the resting position near the handle base toward top portion (326) of the handle, first marker stop (324) retracts away from lowermost marker platform (320) held in the dispensing position (322). At substantially the same time, second marker stop (328) expands or extends to engage marker platform (330) positioned directly above the lowermost marker platform (320) securing that marker platform, and all other marker platforms positioned above it, at a position above the discharging position on the elongate shaft. The flexible marker (332) fastened to the lowermost marker platform (330) unfolds or uncoils from the collapsed position. This uncoiling process is aided by the top portion (334) of the flexible marker pushing off of the lower concave surface (336) of the marker platform secured by the second marker stop directly above the discharging position.

As illustrated by FIG. 8(*c*), as soon as the lowermost marker platform (320) and flexible marker (332) clear the discharging end of the elongate shaft, the second marker stop (obstructed from view in FIG. 8(*c*)) retracts away from the marker platform (330) located directly above the discharging position (322) on the elongate shaft. At substantially the same time, the first marker stop (324) re-expands or re-extends from the outer surface of the elongate shaft and catches or engages marker platform (330) as it slides down the elongate shaft and into the dispensing position (322) on the shaft.

The T-shaped trigger part (314) is once again in the resting state near the base (316) of the handle and the flexible marker holder and dispenser (310) is loaded with two flexible markers (obstructed from view), each attached to a marker platform (312) that are stacked and aligned with one another between the opposite ends of the elongate shaft. In this resting state, the first marker stop (324) is mechanically coupled or engaged with the lowermost marker platform (330) to thereby hold the lowermost marker platform, and all other marker platforms above it, on the elongate shaft. The second marker stop is again in the non-expanded or non-extended position and is not in physical contact with any of the marker platforms (312). The above process is repeated until all marker platforms and flexible markers have been expelled from the marker holder and dispenser.

To load additional markers onto the elongate shaft, the T-shaped trigger part (314) is put in the activated position, at which the first marker stop (324) is in a non-extended state and the second marker stop (328) is in the extended state. A marker platform is then loaded onto the shaft by inserting the shaft through the central opening in the hub of the platform. Once the marker platform clears the dispensing end of the elongate shaft, the T-shaped trigger is returned to the resting position, at which the first marker stop re-extends and the second marker stop is in a non-extended state allowing the newly loaded marker platform, and all others above it, to move upwardly on the elongate shaft. This process can be repeated to individually add marker platforms to the elongate shaft.

It should be understood, however, that the trigger part (314) could have a neutral position at which both of the first or second marker stops are in the non-extended state. This would facilitate the loading of the markers onto the elongate shaft.

Having shown and described various embodiments of the present invention, further adaptations of the devices described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, and the like discussed above are illustrative and are not required. Accordingly, the scope of the present invention should be considered in terms of the following claims and is understood not to be limited to the details of structure and operation shown and described in the specification and drawings.

The invention claimed is:

1. A flexible marker holding and dispensing device, comprising:

an elongate shaft including a proximal end and a distal end extending away from the proximal end;

a handle having a base connected to the proximal end of the elongate shaft and a gripping member positioned above the base;

a trigger component protruding from the elongate shaft at the proximal end, the trigger component being located between the base of the handle and the gripping member of the handle;

a marker engaging mechanism housed within the elongate shaft, the marker engaging mechanism being in communication with the trigger component; and at least one marker platform having an opening formed through a central portion thereof, the at least one marker platform being releasably coupled to the elongate shaft through the opening.

2. The device of claim 1, wherein the trigger component has a resting position located proximate the base of the handle and an activated position located proximate the gripping member of the handle.

3. The device of claim 2, wherein the trigger component is in the activated position and (i) the engaging mechanism is substantially flush with the outer surface of the elongate shaft contacting and securing on of the marker platforms at a discharging area of the distal end of the elongate shaft, and (ii) the engaging mechanism is free from contact with any other marker platform coupled to the elongate shaft.

4. The device of claim 3, wherein the trigger component is in the activated position and (i) the engaging mechanism is substantially flush with the outer surface of the elongate shaft at the discharging area and free from contact with any of the marker platforms, and (ii) the engaging mechanism extends laterally away from the outer surface of the elongate shaft at a holding area above the discharging area and contacts and secures one of the marker platforms at the holding area, wherein every marker platform above the marker platform secured in the holding area is releasably coupled to the elongate shaft.

5. The device of claim 1, wherein each at least one marker platform is releasably fastened to a flexible marker.

* * * * *